US007465075B2

(12) United States Patent
Chinniah et al.

(10) Patent No.: US 7,465,075 B2
(45) Date of Patent: Dec. 16, 2008

(54) LENS ASSEMBLY FOR AN AUTOMOBILE LIGHT ASSEMBLY HAVING LED LIGHT SOURCE

(75) Inventors: Jeyachandrabose Chinniah, Canton, MI (US); Jeffrey Allen Erion, Plymouth, MI (US); Chris L. Eichelberger, Livonia, MI (US); John Li, Northville, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 266 days.

(21) Appl. No.: 11/085,294

(22) Filed: Mar. 21, 2005

(65) Prior Publication Data

US 2006/0209558 A1 Sep. 21, 2006

(51) Int. Cl.
*F21V 5/00* (2006.01)

(52) U.S. Cl. ..... 362/336; 362/334; 362/520; 362/509; 362/521

(58) Field of Classification Search ..... 362/545, 362/336, 334, 335, 520, 509, 293; 359/708, 359/711, 712, 719, 819
See application file for complete search history.

(56) References Cited

U.S. PATENT DOCUMENTS 4,577,260 A * 3/1986 Tysoe ..... 362/521
4,698,730 A * 10/1987 Sakai et al. ..... 362/311
4,767,172 A * 8/1988 Nichols et al. ..... 385/146
4,927,248 A 5/1990 Sakakibara et al.
4,972,302 A 11/1990 Masuyama et al.
5,081,564 A 1/1992 Mizoguchi et al.
5,440,456 A 8/1995 Bertling et al.
5,757,557 A * 5/1998 Medvedev et al. ..... 359/708
5,947,587 A 9/1999 Keuper et al.
6,075,652 A 6/2000 Ono et al.
6,129,447 A * 10/2000 Futami ..... 362/522
6,139,147 A 10/2000 Zhang
6,292,293 B1 9/2001 Chipper
6,327,086 B1 12/2001 Unno
6,334,702 B1 1/2002 Albou
6,352,359 B1 3/2002 Shie et al.
6,367,954 B1 4/2002 Futami
6,402,355 B1 6/2002 Kinouchi
6,471,375 B2 * 10/2002 Kobayashi et al. ..... 362/285
6,536,918 B1 3/2003 Boroczki et al.
6,543,923 B2 4/2003 Tamai
6,604,843 B2 8/2003 Shpizel
6,616,299 B2 9/2003 Martineau
6,626,565 B2 9/2003 Ishida
6,724,543 B1 * 4/2004 Chinniah et al. ..... 359/718
6,726,346 B2 4/2004 Shoji
6,757,109 B2 6/2004 Bos
6,814,475 B2 11/2004 Amano
6,814,480 B2 11/2004 Amano
6,986,594 B2 * 1/2006 Wirth et al. ..... 362/328
2002/0080615 A1 * 6/2002 Marshall et al. ..... 362/333

(Continued)

*Primary Examiner*—Ali Alavi
*Assistant Examiner*—Evan Dzierzynski
(74) *Attorney, Agent, or Firm*—Brinks Hofer Gilson & Lione

(57) ABSTRACT

A light assembly is provided having a lens assembly that splits the function of a near field lens into two components, thereby permitting a manufacturable lens that achieves the desired beam size and intensity. At the same time, increased flexibility and control over the beam spread characteristics is achieved. The first component is an inner lens, while the second component may be a reflector or a second lens.

24 Claims, 3 Drawing Sheets

U.S. PATENT DOCUMENTS

2002/0093820 A1 7/2002 Pederson
2002/0126400 A1 9/2002 Muller-Rissmann et al.
2002/0136022 A1 9/2002 Nakata
2003/0067784 A1 4/2003 Erber
2003/0123159 A1 7/2003 Morita et al.
2003/0218882 A1 11/2003 Wirth et al.
2004/0130904 A1 7/2004 Yamada et al.
2004/0145899 A1 7/2004 Riebling et al.
2004/0257827 A1 12/2004 Ishida et al.
2004/0264199 A1 12/2004 Shu et al.
2005/0073849 A1* 4/2005 Rhoads et al. ..... 362/296
2005/0190564 A1* 9/2005 Amano et al. ..... 362/336

* cited by examiner

LENS ASSEMBLY FOR AN AUTOMOBILE LIGHT ASSEMBLY HAVING LED LIGHT SOURCE

FIELD OF THE INVENTION

The present invention relates generally to lens assemblies for automotive light assemblies, and more particularly relates to lens assemblies structured for use with a LED light source.

BACKGROUND OF THE INVENTION

Light emitting diodes (LED's) are fast becoming the preferable light source for automotive lighting applications, as they consume less power but provide light output which is becoming acceptable for such applications. Near field lenses (NFL's) are used to collect as well as to collimate the light from a LED source. Additional optic power may be added to the NFL to create a certain desired beam pattern. Existing NFL's have very high light collection efficiency (typically 70-90%) regardless of their size, but the output beam size for a given source depends on the size of the lens. The larger the lens size (i.e. the larger the starting focal length of the lens), the smaller of the output beam size and the higher the peak intensity. However, manufacturing larger lenses poses complex molding issues and takes higher molding cycle time, thus requiring expensive molding tools and processes.

Accordingly, there exists a need to provide a lighting assembly having a lens that provides the output beam size and peak intensity for automotive applications, while reducing the time, cost and complexity of manufacture.

BRIEF SUMMARY OF THE INVENTION

The present invention provides a light assembly having a lens assembly that overcomes the drawbacks noted above by splitting the function of a near field lens into two components. The first component is an inner lens, while the second component may be a reflector or a second lens.

One embodiment of the present invention provides a light assembly directing light along a longitudinal axis. The light assembly comprises a LED light source, a first lens member and a second member. The first lens member has a recess receiving the LED light source. The first lens member includes a radial portion and an axial portion. The second member has an interior space receiving the first lens member. The second member defines a reflecting surface. The reflecting surface of the second member receives light passing through the radial portion of the first lens member and directs the light downstream along the longitudinal axis.

According to more detailed aspects, the axial portion of the first lens member includes beam focusing optics. Preferably, the axial portion defines an inner axial surface, wherein the inner axial surface is structured as a Fresnel lens (which reduces thickness), a conical surface, or a free-form surface. The axial portion defines an outer axial surface as well, and one of the inner and outer axial surfaces may be curved to focus the light. The axial portion of the first lens member may also include beam spreading optics such as a plurality of pillows on the outer axial surface. The radial portion defines an inner radial surface and an outer radial surface, and the inner radial surface is preferably flat. The inner radial surface is positioned to reflect light passing therethrough. The outer radial surface is preferably curved in a manner to permit light to pass directly through the outer radial surface with minimal refraction. Alternatively, the inner and outer radial surfaces may both be curved.

According to further detailed aspects, the second member may be a reflector or a lens. When the second member is a lens, the second lens member defines an interior passageway extending through the second lens member which receives the first lens member. The interior passageway defines an interior surface which is structured to refract light from the first lens member. Preferably the interior surface is flat in the axial direction. Alternatively the area interior surface may be structured to match an exterior radial surface of the radial portion of the first lens member, thereby permitting light to pass directly through the interior surface with minimal refraction. The second lens member has an outer surface forming the reflecting surface which uses the principle of total internal reflection. When the second member is a reflector, the reflector preferably has a bowl shape defining an interior surface forming the reflecting surface.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
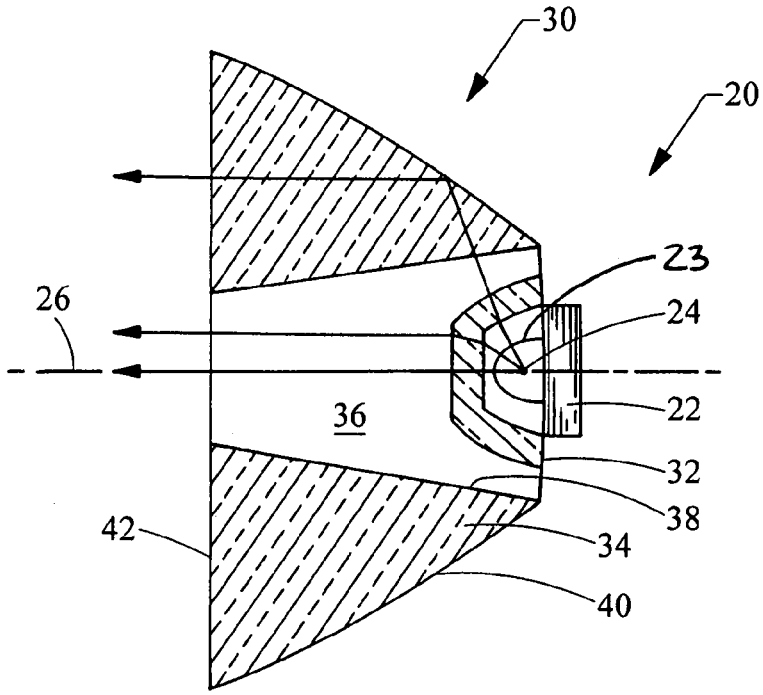
FIG. 1 is a cross-sectional view of a light assembly and lens assembly constructed in accordance with the teachings of the present invention.

Turning now to the figures, FIG. 1 depicts a cross-sectional view of a light assembly 20 having a lens assembly 30 for an automotive lighting application. The light assembly 20 generally includes a LED light source 22 having a cover lens 23 and generating light from a source point 24 downstream along a longitudinal axis 26. The lens assembly 30 collects and collimates the light from the LED light source 22 for generating a desired beam pattern for the particular automotive lighting application. Unnumbered lined arrows have been used throughout the application to depict the path of traveling light.

The lens assembly 30 generally includes a first lens member 32 and a second lens member 34. The second lens member 34 includes an interior passageway 36 defined by a conically shaped interior surface 38. As will be discussed in more detail below, the first lens member 32 directs a portion of the light straight through the internal passageway 36 without entering the second lens member 34. A second portion of the light passes through the interior surface 38, and due to the shape of the outer surface 40 of the second lens member 34 the light is reflected via total internal reflection and redirected longitudinally downstream and through the axial end surface 42 of the second lens member 34.

It will also be recognized by those skilled in the art that the outer surface 40 of the second lens member 34 may include a reflective coating formed thereon (i.e. such as an aluminum coating) to further assist with the reflection of the light or to permit a different curvature or structure to be given to the outer surface 40 of the second lens member 34.

Additional details of the first lens member 32 will now be described will reference to FIG. 2. As shown, the first lens member 32 defines a recess 44 receiving the LED light source 22. The first lens member 32 thus comprises a radial portion 45 connected to an axial portion 47. The radial portion 45 is generally defined by an inner radial surface 46 and an outer radial surface 50. Similarly, the axial portion 47 is generally defined by an inner axial surface 48 and an outer axial surface 52. Accordingly, the recess 44 is generally defined by the inner radial surface 46 and the inner axial surface 48.

As light emanates from the light source origin 24, a portion of the light will pass through the axial portion 47. In this embodiment, the axial portion 47 has been formed as a Fresnel lens, the structure of which is well known in the art. Briefly stated, the inner axial surface 48 is comprised of a series of arcuate channels 54, while the outer axial surface 47 is flat and planar, and generally perpendicular to the longitudinal axis 26. As used herein, the term generally perpendicular means line or surface that is within about 3 degrees of true perpendicularity.

Another portion of the light emanating from origin point 24 will pass through the radial portion 45 of the first lens member 32. As shown in FIG. 2, the inner radial surface 46 is generally flat, and more particularly is conical or tapered as it extends longitudinally downstream. As such, light passing through the inner radial surface 46 will be refracted as shown by the arrows indicating the light path. The outer radial surface 50 has been structured in a free form curvature (i.e. numerically generated) such that the light passing through the radial portion 45, as refracted by the radial inner surface 46, is permitted to pass directly through the outer radial surface 50 with zero refraction for a point source and minimal refraction for a finite source. As used herein, the term minimal refraction refers to a range of refraction between 0 and 3 degrees.

Referring back to FIG. 1, it can therefore be seen that the axial portion 47 of the first lens member 32 serves as a focusing lens to direct the light longitudinally downstream and through the interior passageway 36 of the second lens member 34. This light can assist in forming a "hot spot" in the resulting beam pattern. Additionally, light passing through the radial portion 45 is redirected towards the second lens member 34, and in particular the interior surface 38. The radial portion 45 of the first lens member 32 and the second lens member 34 are structured and positioned relative to one another to collect a substantial portion of the light, collimate the light, and redirect the light longitudinally downstream via total internal reflection. Here, the flat and conical interior surface 38 refracts the light, which is then reflected by the outer surface 40 and directed downstream.

Figure 2:
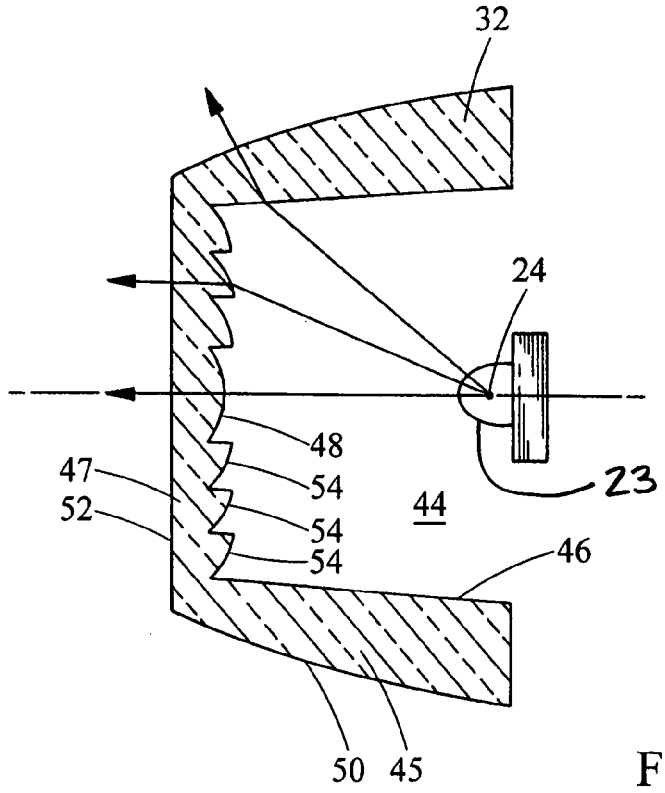
FIG. 2 is a cross-sectional view of a first lens member of the lens assembly.
Figure 3:
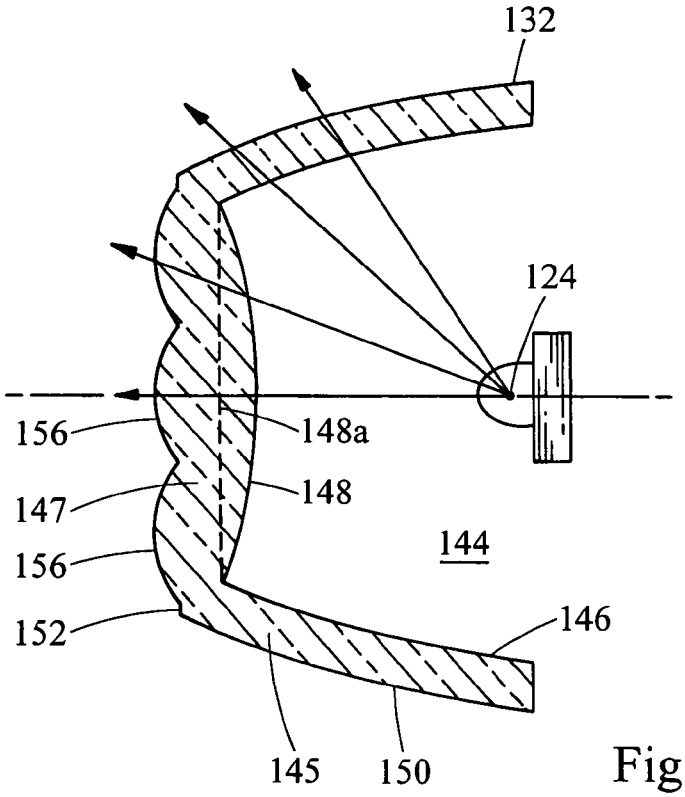
FIG. 3 is a cross-sectional view of an alternate embodiment of the first lens member depicted in FIGS. 1 and 2.

Turning now to FIG. 3, an alternate embodiment of the first lens member 132 is depicted. As in the prior embodiment, the first lens member 132 generally includes a radial portion 145 and an axial portion 147. However, in this embodiment the radial portion 145 includes a curved inner radial surface 146. The curvature of the inner and outer radial surfaces 146, 150 may be structured so that the light passing therethrough is only minimally refracted, or may be structured to refract the light in a manner acceptable for use by the second lens member, which is structured according to the principles described in the embodiment of FIGS. 1-2.

It can also be seen in the embodiment of FIG. 3 that the axial portion 147 includes an inner axial surface 148 that is curved to form a lens for collimating the light. However, it will be recognized by those skilled in the art that the inner axial surface 148 could be flat, as shown by dotted line 148*a* while the outer axial surface 152 includes a curvature for focusing the light rays.

It will also be recognized that while the axial portion 147 has been shown as generally including beam focusing optics such as the Fresnel lens of FIG. 2, or the lens 148 of FIG. 3, the axial portion may also include beam spreading optics. As one example, the outer axial surface 152 has been shown as including plurality of pillows 156. As is known in the art, such pillows or flutes serve to spread the light passing through the axial portion 147, and generally create a beam pattern which is ideal for applications such as brake lights, tail lights and the like. While the beam spreading optics 156 have been shown used in conjunction with a beam focusing optics 148 in FIG. 3, it will be recognized that the beam spreading optics 156 can be used alone (i.e. in conjunction with a flat axial inner surface 148*a*).

Figure 4:
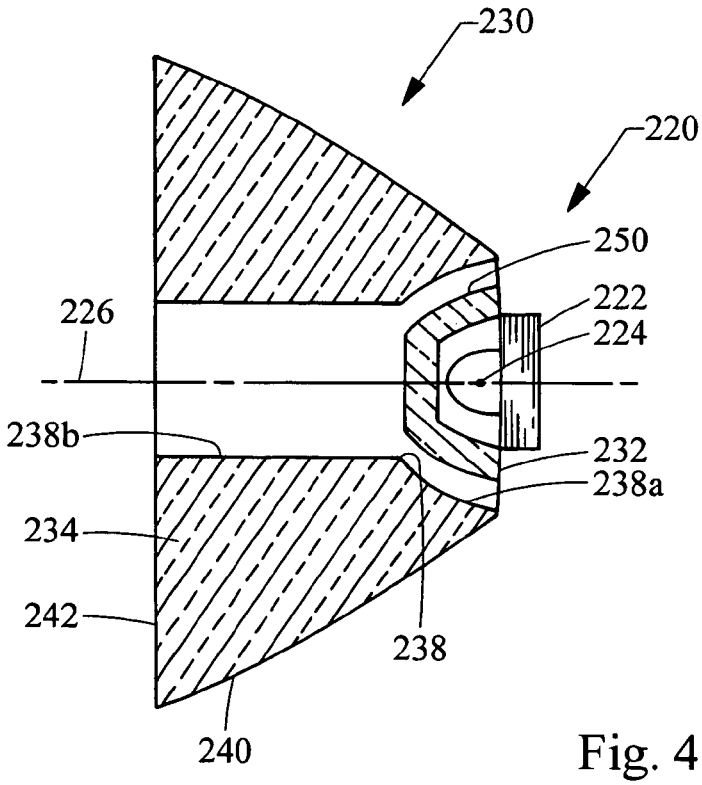
FIG. 4 is a cross-sectional view of an alternate embodiment of the light assembly and lens assembly depicted in FIG. 1.

Yet another alternate embodiment of the light assembly 220 and lens assembly 230 is depicted in FIG. 4. In this embodiment, the LED light source 220 generates light from a point or origin 224 which is collected and directed by first lens member 232 in a substantially similar fashion as the prior embodiments. However, in this embodiment the second lens member 234 includes an interior passageway 236 defined by an interior surface 238 that is structured to match the outer surface 250 of the first lens member 232. That is, the interior surface 238 may be structured such that all light it receives from the first lens member 232 passes directly through the interior surface 238 with minimal refraction. In the embodiment depicted, the interior surface 238 has been divided into an upstream portion 238*a* and a downstream portion 238*b*. The upstream portion 238*a* is given a curvature which matches the curvature of the outer radial surface 250 of the first lens member 232. The downstream portion 238*b* may then be made simply cylindrical, or alternatively could be conical as in the prior embodiment. Furthermore, it will be recognized by those skilled in the art that depending upon the structure of the radial portion of the first lens member 232, the entire interior surface 238 may be given a curvature, typically a free-form curvature, which is structured to correspond to the path of light passing through the radial portion of the first lens member 232, resulting in minimal refraction of the light through the interior surface 238. As with the prior embodiments, the second lens member 234 includes an outer surface 240 which serves to reflect and collimate the light longitudinally downstream along the longitudinal axis 226.

Figure 5:
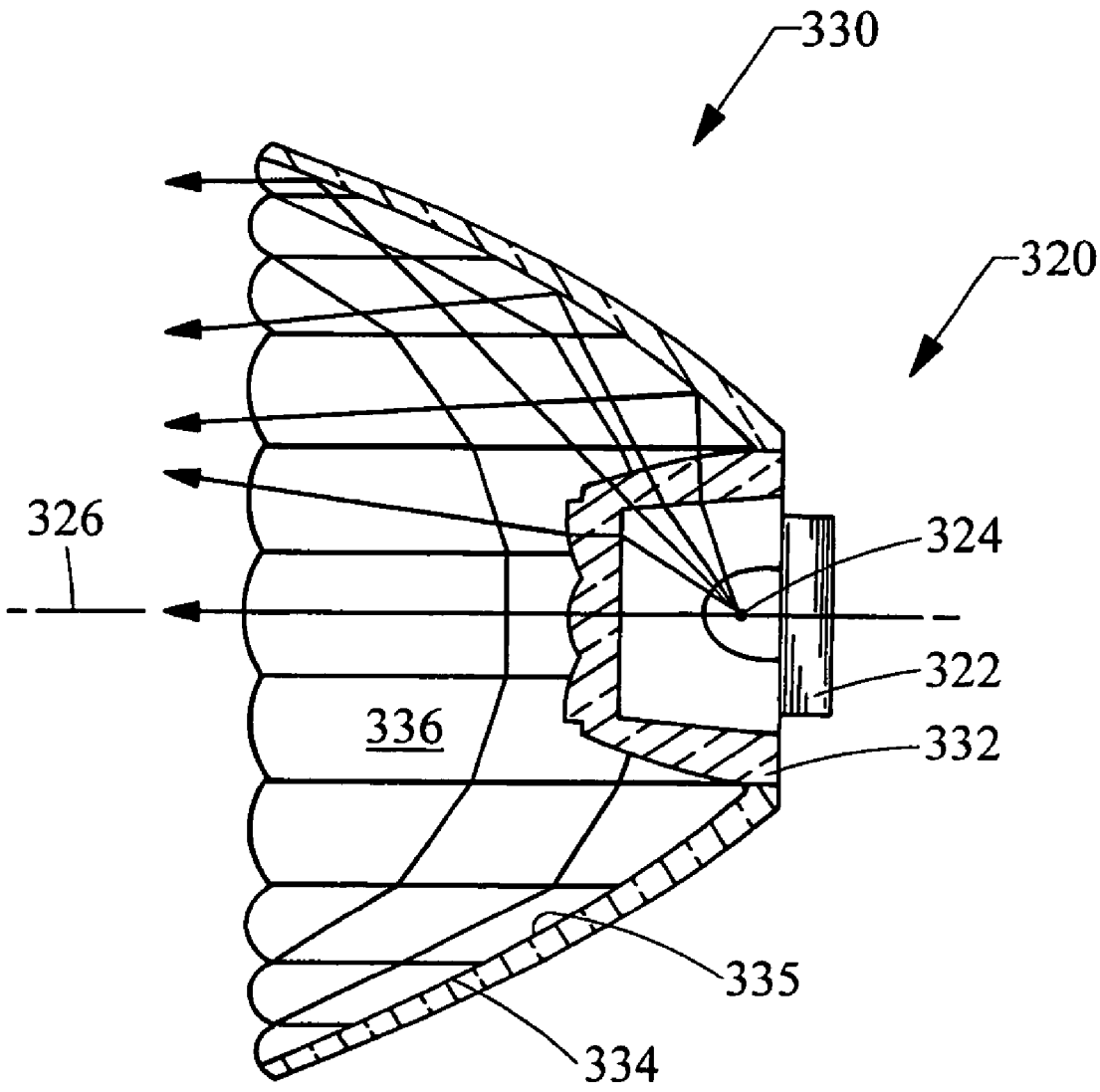
FIG. 5 is an alternate embodiment of the light assembly with the inner lens of FIG. 2 and FIG. 3.

A final embodiment has been depicted in FIG. 5. In this embodiment, the light assembly 320 and lens assembly 330 include an LED light source 322 generating light from origin 324 through a first lens member 332, all of which may be constructed in accordance with the teachings of the present invention and the prior embodiments. However, in this embodiment the second lens member has been replaced with a reflector 334. The reflector 334 has a general bowl shape and includes an interior surface 335 defining an interior chamber 336 which receives the first lens member 332. Preferably, the interior surface 335 is structured to include a plurality of facets which result in a redirection of the light emitted from the first lens member 332 with some predetermined beam spread characteristics, such as is shown by the lined arrows of FIG. 5. It will be recognized by those skilled in the art that a number of types of reflectors 334 may be used to generate the desired beam pattern for the particular automotive application.

By way of the present invention, an automotive light assembly is provided having a lens assembly that overcomes the drawbacks of forming a single NFL of a relatively large size (i.e. a larger focal length) by splitting the function of the lens into a first lens member and a second member. In this manner, the lenses may be formed by conventional techniques and conventional tools. Further, with members, more flexibility and opportunity to adjust or impact the beam spread characteristics is possible. Thus, the present invention provides smaller output beam size and higher peak intensity, as well as increased flexibility, without the complex molding issues and expensive tools and processes.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A light assembly for an automotive lighting application, the light assembly directing light along a longitudinal axis, the light assembly comprising:

a LED light source having a cover lens;

a first lens member having a recess receiving the LED light source, the first lens member including a radial portion and an axial portion defining the recess;

a second lens member having an interior space receiving the first lens member, an outer surface of the second lens member defining a reflecting surface; and the reflecting surface of the second lens member receiving light passing through the radial portion of the first lens member and through an inner surface of the second lens member, the reflecting surface directing the light downstream along the longitudinal axis through the second lens member.

2. The light assembly of claim 1, wherein the axial portion of the first lens member includes beam focusing optics.

3. The light assembly of claim 2, wherein the axial portion defines an inner axial surface, and wherein the inner axial surface is structured as a Fresnel lens.

4. The light assembly of claim 2, the axial portion defines an inner axial surface and an outer axial surface, and wherein one of the inner and outer axial surfaces is curved to focus the light.

5. The light assembly of claim 1, wherein the axial portion of the first lens member includes beam spreading optics.

6. The light assembly of claim 5, wherein the axial portion of the first lens member defines an outer axial surface, and wherein the outer axial surface includes a plurality of pillows.

7. The light assembly of claim 1, wherein the radial portion defines an inner radial surface and an outer radial surface, and wherein the inner radial surface is flat in the axial direction.

8. The light assembly of claim 1, wherein the radial portion defines an inner radial surface and an outer radial surface, and wherein the inner radial surface is positioned to refract light passing therethrough.

9. The light assembly of claim 1, wherein the radial portion defines an inner radial surface and an outer radial surface, and wherein the outer radial surface is curved.

10. The light assembly of claim 9, wherein the curvature of the outer radial surface is structured to permit light to pass directly through the outer radial surface with minimal refraction.

11. The light assembly of claim 1, wherein the radial portion defines an inner radial surface and an outer radial surface, and wherein the inner and outer radial surfaces are both curved.

12. The light assembly of claim 1, wherein the first lens member is not a component of the LED light source.

13. A light assembly for an automotive lighting application, the light assembly directing light along a longitudinal axis, the light assembly comprising:

a LED light source having a cover lens;

a first lens member having a recess receiving the LED light source, the first lens member including a radial portion and an axial portion;

a second lens member defining an axial end surface and an outer radial surface, the second lens member having an interior passageway extending through the axial end surface of the second lens member, the interior passageway receiving the first lens member, the outer radial surface of the second member structured and positioned relative to the first lens member to receive light passing through the radial portion of the first lens member and direct the light downstream along the longitudinal axis.

14. The light assembly of claim 13, wherein the interior passageway defines an interior surface, and wherein the interior surface is structured to refract light from the first lens member.

15. The light assembly of claim 13, wherein the interior surface is flat in the axial direction.

16. The light assembly of claim 13, wherein the interior passageway defines an interior surface, and wherein the interior surface is structured to match an exterior radial surface of the radial portion of the first lens member, whereby light passes directly through the interior surface with minimal refraction.

17. The light assembly of claim 13, wherein the interior passageway narrows in the downstream direction.

18. A lens assembly for a LED light source, the lens assembly comprising:

a first lens member having a recess receiving the LED light source, the first lens member including a radial portion and an axial portion defining the recess, the radial portion being angled relative to the axial portion, the axial portion refracting light passing therethrough;

a second member having an interior space receiving the first lens member, the second member defining a reflecting surface; and the reflecting surface of the second member receiving light passing through the radial portion of the first lens member and reflecting the light downstream along the longitudinal axis.

19. The light assembly of claim 18, wherein the second member is a reflector having a bowl shape defining an interior surface forming the reflecting surface.

20. The light assembly of claim 18, wherein the second member is a lens having an outer surface forming the reflecting surface.

21. The light assembly of claim 18, wherein the radial portion defines an inner radial surface and an outer radial surface, and wherein the inner radial surface is flat in the axial direction.

22. The light assembly of claim 18, wherein the axial portion of the first lens member includes beam focusing optics.

23. The light assembly of claim 18, wherein an inner axial surface of the axial portion meets an inner radial surface of the radial portion along an annular line.

24. The light assembly of claim 18, wherein the second member does not receive light passing through the axial portion of the first lens member.

* * * * *